US007565777B2

(12) United States Patent
Sweeney et al.

(10) Patent No.: US 7,565,777 B2
(45) Date of Patent: Jul. 28, 2009

(54) Z-BEND, NESTABLE TIES

(75) Inventors: Jeff S. Sweeney, Atlanta, GA (US); Wei Wei Chen, Alpharetta, GA (US); Charles Barry Ward, Alpharetta, GA (US)

(73) Assignee: East West Manufacturing, LLC, Atlanta, GA (US)

( * ) Notice: Subject to any disclaimer, the term of this patent is extended or adjusted under 35 U.S.C. 154(b) by 490 days.

(21) Appl. No.: 11/186,637

(22) Filed: Jul. 21, 2005

(65) Prior Publication Data

US 2006/0037276 A1 Feb. 23, 2006

Related U.S. Application Data

(60) Provisional application No. 60/589,732, filed on Jul. 21, 2004.

(51) Int. Cl.
*E04C 1/00* (2006.01)

(52) U.S. Cl. ..... 52/383; 52/309.11; 52/309.16; 52/379; 52/426

(58) Field of Classification Search ..... 52/309.11, 52/426, 431, 454, 565, 664, 686, 687, 712, 52/309.16, 379, 432, 562; 245/8; 206/321, 206/449; 249/38, 40, 190, 213
See application file for complete search history.

(56) References Cited

U.S. PATENT DOCUMENTS

| | | | | | |
|---|---|---|---|---|---|
| 976,503 | A * | 11/1910 | Schroeder, Jr. | ..... | 52/687 |
| 1,498,595 | A * | 6/1924 | Wedmore | ..... | 52/719 |
| 1,830,888 | A * | 11/1931 | Ribb | ..... | 52/686 |
| 3,145,505 | A * | 8/1964 | Cornelius | ..... | 52/712 |
| 4,698,947 | A | 10/1987 | McKay | | |
| 4,742,659 | A | 5/1988 | Meilleur | | |
| 4,939,883 | A * | 7/1990 | Swenson | ..... | 52/686 |
| 5,762,196 | A * | 6/1998 | Waldhauser et al. | ..... | 206/499 |
| 5,763,196 | A * | 6/1998 | Powell et al. | ..... | 435/7.6 |
| 5,887,401 | A | 3/1999 | Moore, Jr. | | |
| 6,321,497 | B1 | 11/2001 | Cormier | | |
| 7,243,897 | B2 * | 7/2007 | Huber et al. | ..... | 249/34 |
| 2002/0124508 | A1 | 9/2002 | Dunn | | |
| 2004/0045237 | A1 * | 3/2004 | Coombs et al. | ..... | 52/309.11 |

* cited by examiner

*Primary Examiner*—Basil Katcheves
(74) *Attorney, Agent, or Firm*—Smith Gambrell & Russell LLP

(57) ABSTRACT

A tie for insulated concrete forms that has a Z-bend configuration so that the tie is nestable with similar Z-bend ties in order to optimize the cubic volume and the weight of a container of nested ties for shipment.

4 Claims, 6 Drawing Sheets

Z-BEND, NESTABLE TIES

RELATED APPLICATION

This application claims the benefit of priority of U.S. provisional application Ser. No. 60/589,732, filed Jul. 21, 2004, which is relied on and incorporated herein by reference.

FIELD OF THE INVENTION

The present invention relates to insulated concrete forms ("ICF") and particularly to the ties used in such ICFs.

BACKGROUND OF THE INVENTION

ICFs generally comprise two walls or slabs of foam (usually expanded polystyrene foam ("EPS")) held apart a defined distance by a series of ties. An ICF is used to construct a one-piece, monolithic concrete wall with reinforced concrete posts and beams. The ICF remains in place and provides an energy efficient concrete wall that can be finished with conventional interior and exterior wall coverings. The ties serve to space the two foam walls of the ICF a uniform distance apart and to prevent the walls of the ICF from spreading as the hydraulic pressure of the wet concrete fills the form. A conventional ICF with conventional ties is shown in FIGS. 1-3.

The conventional ICF 10 shown in FIGS. 1-3 consists of two walls 12 and a plurality of ties 14. Each tie 14 is comprised of crosstie elements 16 and reinforcing elements 18. The ties 14 shown in FIGS. 1-3 hold the walls 12 in place as concrete 5 is poured into the ICF 10. Further, as shown in FIGS. 1 and 3, the ties 14 may have a furring strip 15 connected to, and extending along each side of, the crosstie elements 16 of the tie 14. Each furring strip 15 generally consists of a solid sheet of plastic or metal. The furring strips 15 give greater resistance to wall separation during concrete 5 pouring and also serve as anchor strips into which screws or other fasteners may be inserted to hold finish materials such as drywall or siding to the outside of the form walls 12.

The prior art ties 14 are made either of injection molded plastic or formed or welded wire and sheet metal. As shown in FIG. 2, the prior art ties 14 are bent into a conventional U-shaped configuration before the ties are molded into the foam block walls 12 of the ICF 15. The ties 14 are bent into the conventional U-shaped, or an H-shaped configuration, either at the time they are made or in a subsequent forming operation.

These conventional U-shaped and H-shaped configurations are designed to meet criteria related to the function of the ICF. The conventional U-shaped and H-shaped ties do not, however, result in efficient shipping configurations. Particularly, the conventional U-shaped and H-shaped ties tend to fill up the available cubic volume in a transport vehicle long before the weight limit of that vehicle is reached. This increases freight, warehousing, and handling costs of the conventional U-shaped and H-shaped ties, as well as scrap due to damage, between the point where the ties are made and the point where the ties are molded into the ICF.

One attempted method to solve the problem outlined above is shipping and handling the ties in a flat configuration before the ties are formed into the conventional U-shaped or H-shaped configuration. The flat ties are then formed into the conventional U-shaped or H-shaped configuration at the EPS molding site or at a nearby third party. Difficulties are encountered with shipping ties in a flat configuration because EPS molders typically do not have forming or die bending experience (resulting in inefficient operations and high waste), and the use of third party benders increases the length of the supply chain resulting in more work in progress inventory, increased handling costs, and lack of single point responsibility for quality control.

SUMMARY OF THE INVENTION

The present invention overcomes the problems above by means of a Z-bend, nestable tie design. The Z-bend ties nest within each other so that the weight and cubic volume limits of conventional shipping containers are efficiently matched.

According to one aspect of the present invention a tie is provided for an ICF comprising a first planar section of intersecting elements, the first planar section having a first side, a second side, a first end, and a second end; a second planar section connected to the first side of the first planar section at approximately a right angle; a third planar section connected to the second side of the first planar section at an angle greater than 90 degrees; and a fourth planar section connected to the third planar section at an angle less than 90 degrees.

In one embodiment, a first furring strip is connected to the second planar section of the tie. Likewise, a second furring strip may be connected to the fourth planar section of the tie.

According to another aspect of the present invention a tie is provided for an ICF comprising at least one crosstie element and at least one reinforcing element. Each crosstie element has a first side section, a central section, and a second side section. The second side section comprises a first portion connected to the central section at an angle greater than 90 degrees and a second portion connected to the first portion at an angle less than 90 degrees. Each reinforcing element is connected to the central section of at least one crosstie element.

In one embodiment, a first furring strip is connected to the first side sections of the crosstie elements. Likewise, a second furring strip may be connected to the second side sections of the crosstie elements.

When the Z-bend ties of the present invention are used with molded EPS walls of an ICF, no visible difference is apparent to the end user of the forms. Further, the Z-bend ties can be used in the existing EPS molding dies, thus allowing immediate use without expensive tooling modifications.

Importantly, the Z-bend ties are nestable which allows for much lower transport costs for the Z-bend ties. Consequently, the Z-bend ties can be made and formed at one factory and shipped worldwide for use at multiple EPS molding plants. For instance, for the conventional U-shaped ties, the number of U-shaped ties which fit in a 40 ft. container is between 14,820 and 44,400, depending upon exact tie size. With the Z-bend tie of the present invention, that range for a 40 ft. container is 33,120 to 73,600 ties, a number which reaches the weight limit for containers at about the same point the cubic volume limit is reached.

In addition, the nesting action of Z-bend ties tends to reinforce each other in the nested stack, giving a synergistic effect which makes each individual tie as strong as the nested stack. Consequently, nesting of the Z-bend ties greatly cuts down on handling damage and the resulting waste experienced with the prior art conventional U-shaped or H-shaped ties which are much more vulnerable to damage during transport.

Moreover, The Z-bend ties can be made and formed at one facility, improving quality control and shortening the supply chain. The Z-bend configuration and advantages work for either bent or formed metal ties or injection molded plastic ties.

All of the above is accomplished without the need for equipment modifications to use the new Z-bend tie, and without alerting the end-users that any changes have been made to the insulated concrete form. The functionality of the Z-bend tie, in terms of holding the forms in place, resisting separation, anchoring finish materials is unchanged from that of the conventional U-shaped and H-shaped ties.

Further objects, features and advantages will become apparent upon consideration of the following detailed description of the invention when taken in conjunction with the drawing and the appended claims.

DETAILED DESCRIPTION OF THE INVENTION

Figure 4:
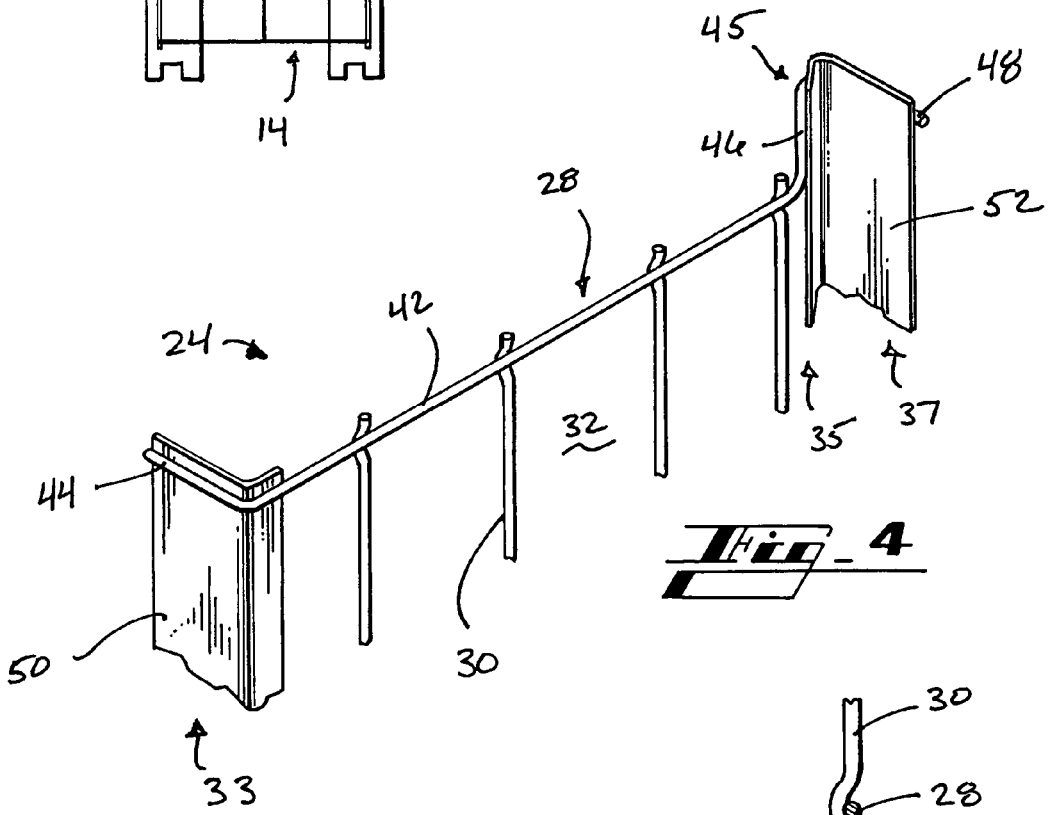
FIG. 4 is a perspective view of a Z-bend tie in accordance with the present invention with furring strips.
Figure 5:
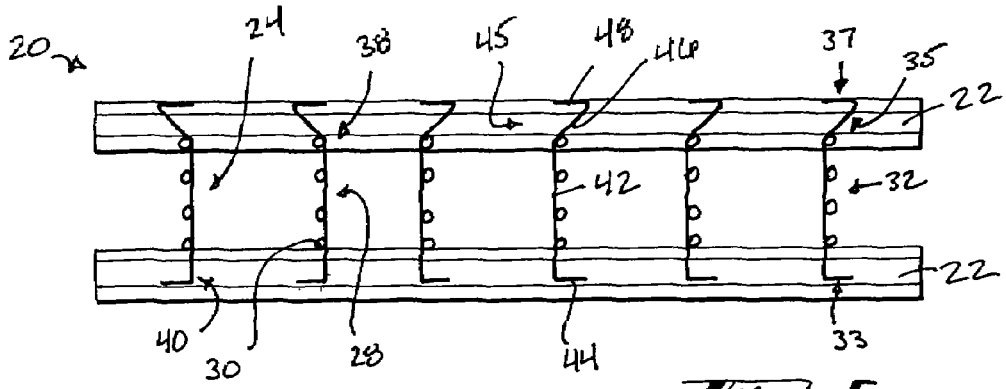
FIG. 5 is a top plan sectional view of an ICF with Z-bend ties in accordance with the present invention.
Figure 6:
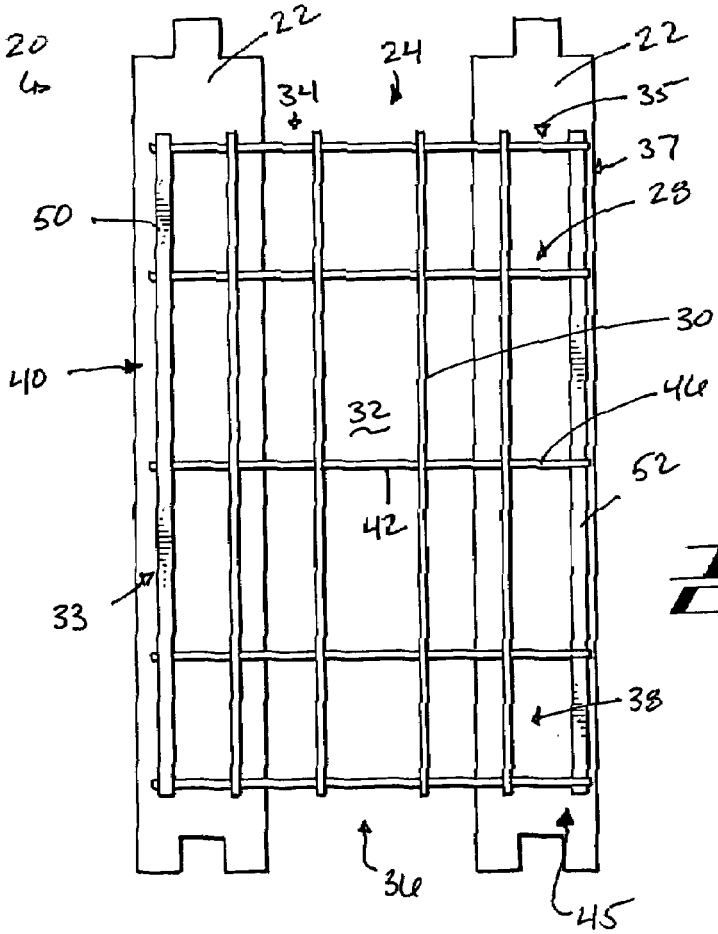
FIG. 6 is a front sectional view of the ICF with Z-bend ties in accordance with the present invention.

With reference to FIGS. 4-6, a tie 24 in accordance with the present invention, for an ICF 20 consisting of walls or slabs of EPS foam 22, is illustrated. According to one aspect of the present invention, the tie 24 comprises a first planar section 32, a second planar section 33, a third planar section 35, and a fourth planar section 37. The first planar section 32 is formed of intersecting elements 28 and 30 and has a first side 40, a second side 38, a first end 34, and a second end 36. The second planar section 33 is connected to the first side 40 of the first planar section 32 at approximately a right angle. The third planar section 35 is connected to the second side 38 of the first planar section 32 at an angle greater than 90 degrees. The fourth planar section 37 is connected to the third planar section 35 at an angle less than 90 degrees.

In one embodiment, shown in FIGS. 4 and 6, a first furring strip 50 extends across and is connected to the second planar section 33 of the tie 24. Likewise, a second furring strip 52 may extend across and be connected to the third planar section 35 and the fourth planar section 37 of the tie 24. In another embodiment, the second furring strip 52 may only extend across and be connected to the fourth planar section 37 of the tie. The first furring strip 50 and the second furring strip 52 function as anchor strips into which screws or other fasteners may be inserted to hold finish materials such as drywall or siding on the outside of the walls 22.

According to another aspect of the present invention, the tie 24 comprises at least one crosstie element 28 and at least one reinforcing element 30. Each crosstie element 28 has a first side section 44, a central section 42, and a second side section 45. The first side section 44 is connected to the central section 42 at approximately a right angle. The second side section 45 comprises a first portion 46 connected to the central section 42 at an angle greater than 90 degrees, and a second portion 48 connected to the first portion 46 at an angle less than 90 degrees. Each reinforcing element 30 is connected to the central section 42 of at least one crosstie element 28.

In one embodiment, shown in FIGS. 4 and 6, a first furring strip 50 extends across and is connected to the first side section 44 of the tie 24. Likewise, a second furring strip 52 may extend across and be connected to the second side section 45 of the tie 24. In another embodiment, the second furring strip 52 may only extend across and be connected to the second portion 48 of the second side section 45 of the tie. The first furring strip 50 and the second furring strip 52 function as anchor strips into which screws or other fasteners may be inserted to hold finish materials such as drywall or siding on the outside of the walls 22.

Figure 1:
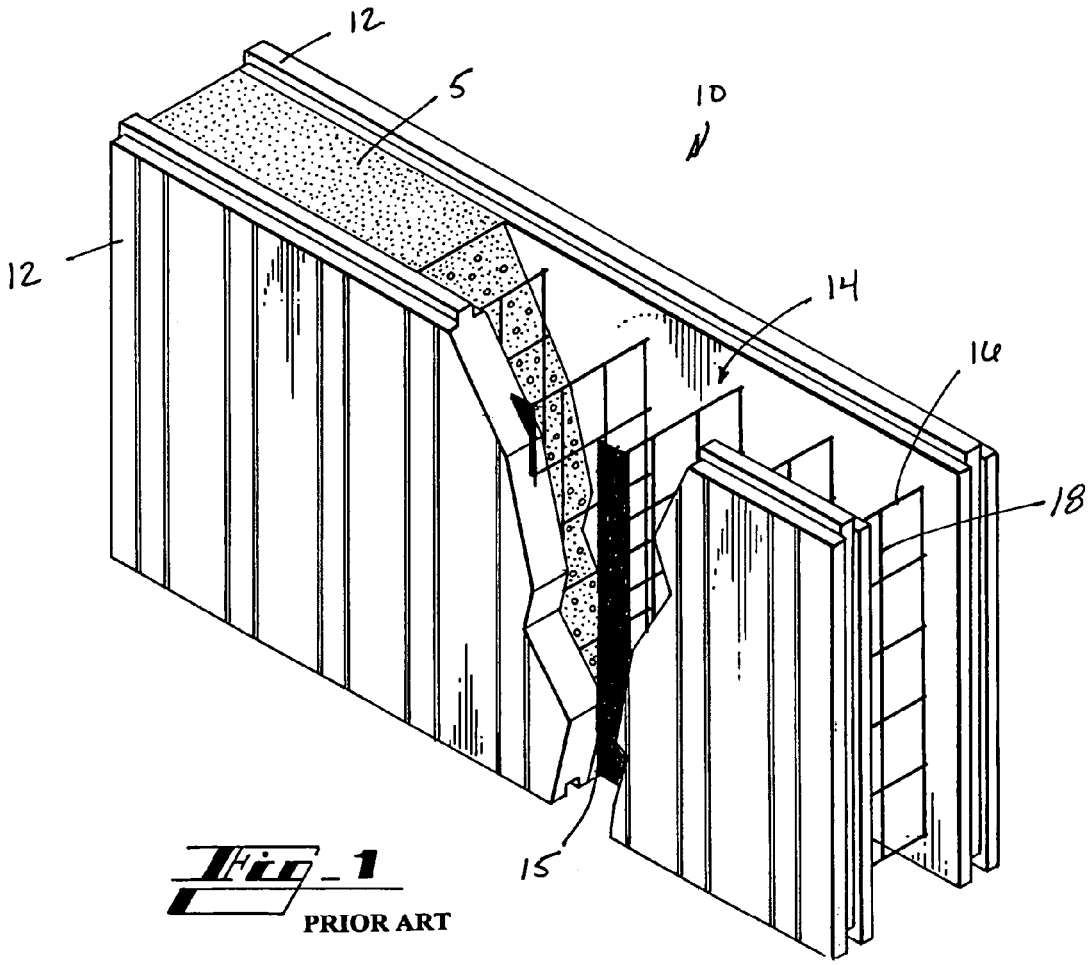
Fig 1 PRIOR ART
FIG. 1 is a perspective view of the prior art ICF with cutaway portions to show conventional, prior art ties.
Figure 2:
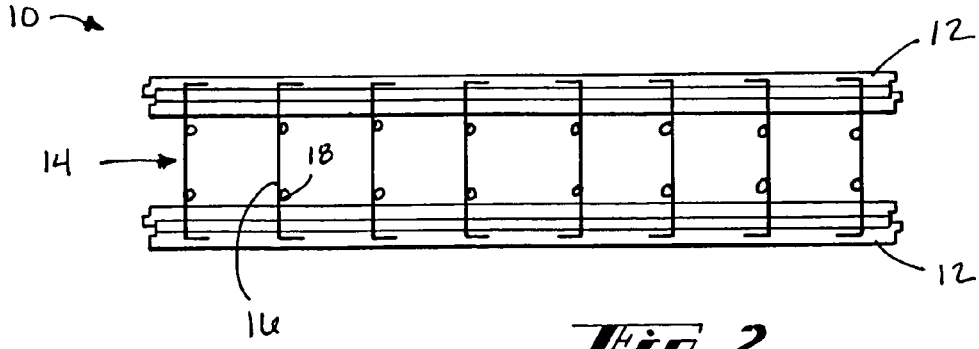
Fig 2 PRIOR ART
FIG. 2 is a top plan sectional view of the prior art ICF illustrated in FIG. 1.
Figure 3:
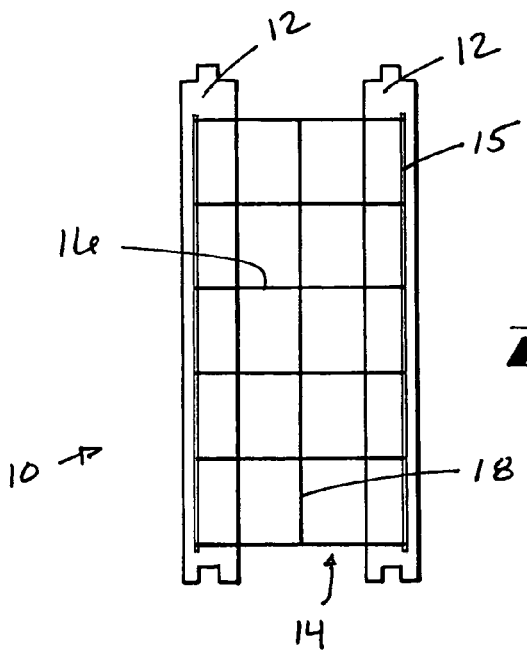
Fig. 3 PRIOR ART
FIG. 3 is a front sectional view of the prior art ICF illustrated in FIG. 1.

The ties 24, when used in connection with the walls 22 of the ICF 20, function in the same manner as the conventional U-shaped ties 14, shown in the prior art FIGS. 1-3, or as the conventional H-shaped ties. Moreover, because the second planar section 33, the third planar section 35, and the fourth planar section 37 (or, in another aspect of the present invention, the first side section 44 and the second side section 45 of the crosstie elements 28) are encapsulated within the EPS walls 22 (FIGS. 5 and 6), the end user is unable to identify that the tie 24 of the present invention is used instead of the conventional U-shaped or H-shaped tie of the prior art.

In one embodiment of the present invention, the tie 24 is constructed by bending the tie 24 from a flat configuration into the Z-shaped ties 24 of the present invention. In another embodiment, the tie 24 may be constructed of formed metal. In a still other embodiment, the tie 24 may be constructed of injection molded plastic.

Figure 7:
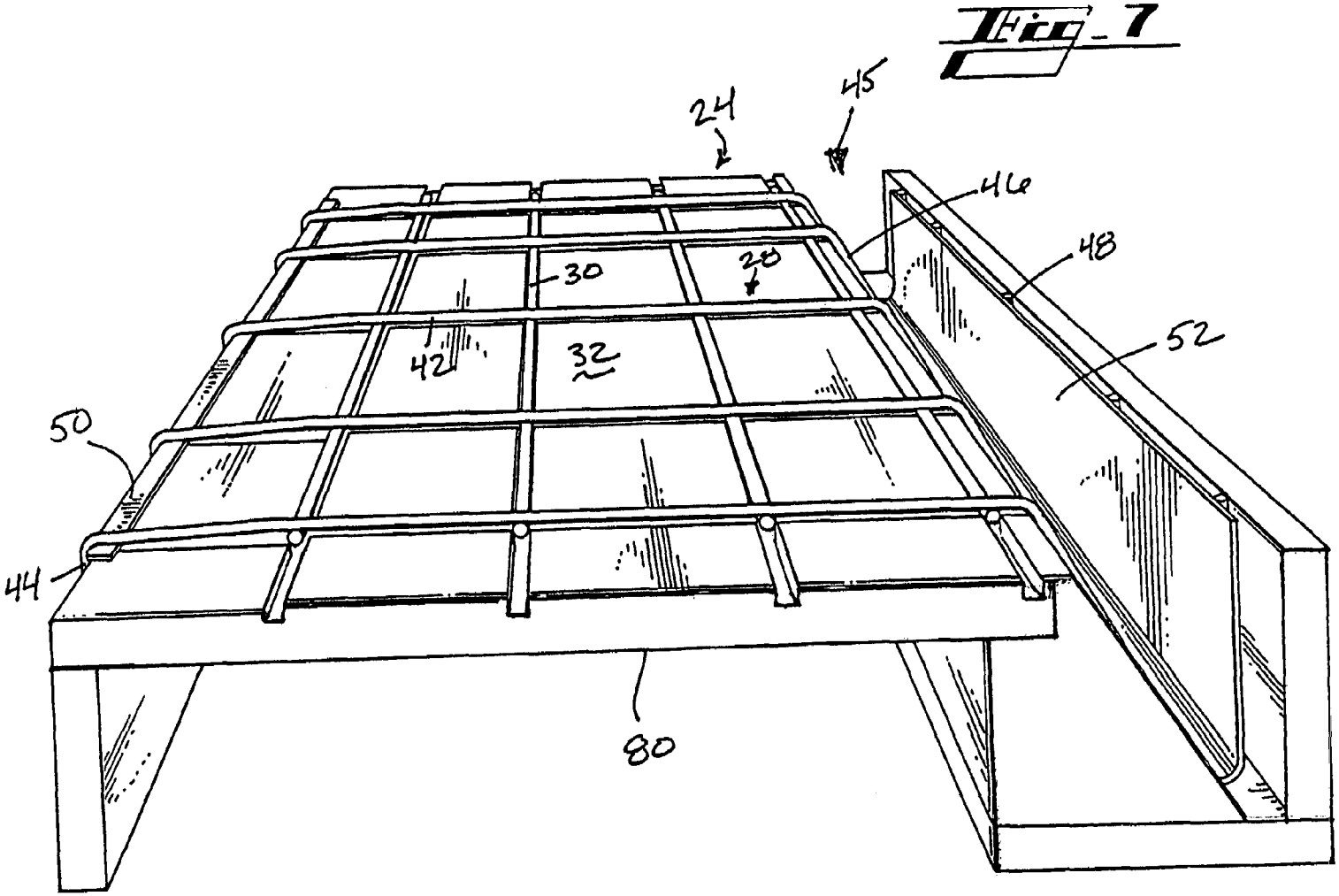
FIG. 7 is a perspective view of the Z-bend tie in accordance with the present invention supported on a gauge.

With reference to FIG. 7, the tie 24 is shown on a gauge 80. The gauge 80 is used for quality control purposes and may be constructed of aluminum, steel, or any dimensionally stable material.

Figure 8:
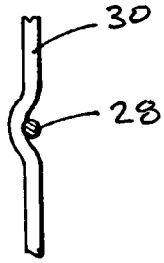
FIG. 8 is a side sectional view of a reinforcing section bent over a crosstie element in a Z-bend tie in accordance with the present invention.

With reference to FIGS. 4 and 8, in one embodiment of the present invention, the tie 24 is constructed by bending the reinforcing element 30 over the central section 42 of the crosstie element 28. The reinforcing element 30 may be connected to the crosstie element 28 by spot welding or any other suitable means.

Figure 9:
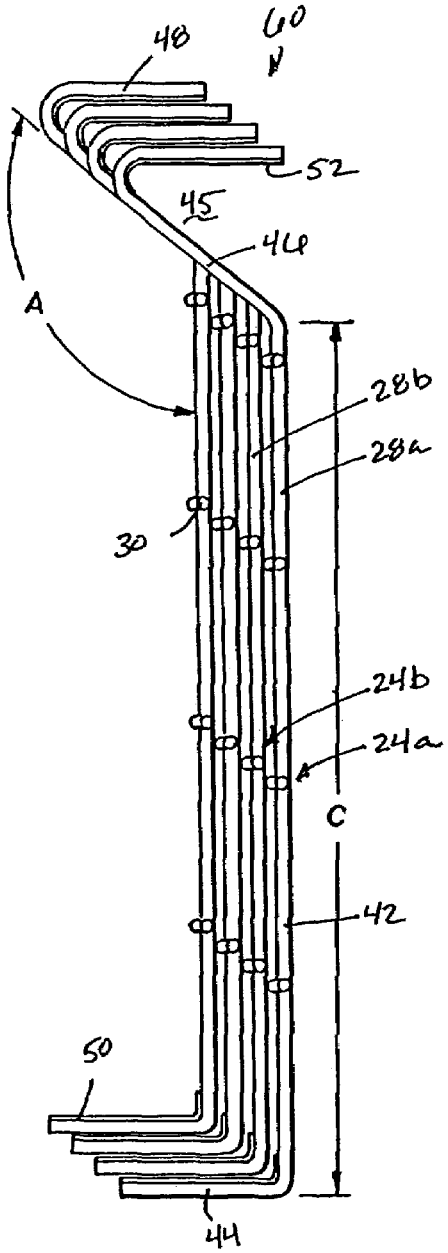
FIG. 9 is a top plan view of 8 inch Z-bend ties nested in accordance with the present invention.
Figure 10:
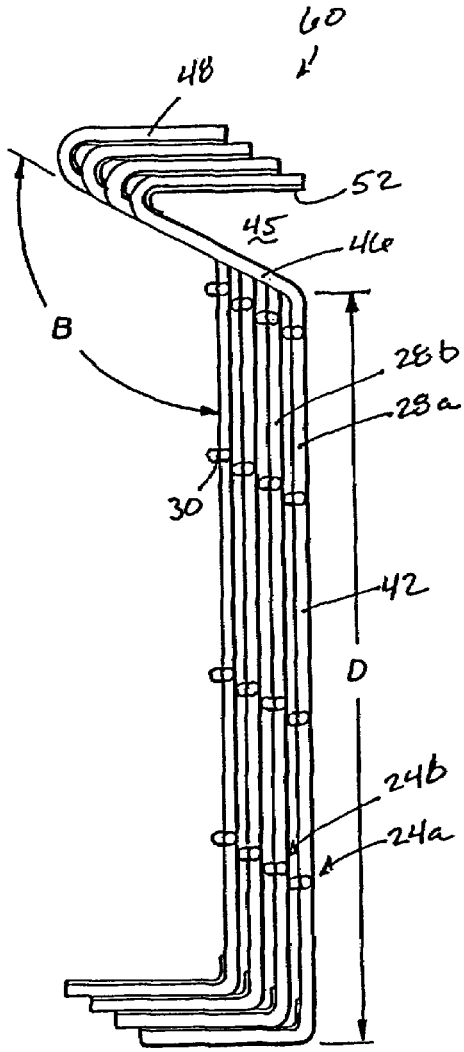
FIG. 10 is a top plan view of 6 inch Z-bend ties nested in accordance with the present invention.

Importantly, the Z-bend ties 24 in accordance with the present invention may be nested to form a stack 60, as shown in FIGS. 9 and 10. Shipping the Z-bend ties 24 in a nested stack 60 produces lower transport costs as compared to the conventional U-shaped and H-shaped ties which are not nestable. Consequently, the Z-bend ties 24 can be made and formed at one factory and shipped worldwide for use at multiple EPS molding plants.

In certain embodiments, ties 24 of the present invention may range in size (width×length) from 7 in.×12 in. to 12 in.×21 in. The first side section 44 and the second side section 45 of each crosstie element 28 may each extend about 1.5 in. from the center section 42 of the crosstie element 42. Ties 24 may range in weight from approximately 0.5 lbs to 1.2 lbs depending upon area of the first planar section 32. The average weight per planar square foot for such ties 24 is approximately 0.75 lbs per square foot.

With continuing reference to FIGS. 9 and 10, ties 24 within the range outlined above are stacked one on top of the other. As shown, a first tie 24*a* in accordance with the present invention is adapted to receive a like second tie 24*b* for nesting more than one tie in a stack 60. In particular, each crosstie element 28*a* of the first tie 24*a* is adapted to receive each like crosstie element 28*b* of the second tie 24*b*. The second side sections 45 of the crosstie elements 28 are adapted to overlap each other as the ties 24 are shifted back-and-forth (into and out of the page of FIGS. 9 and 10) by the thickness of the crosstie element 28.

In one embodiment, as shown in FIG. 9, an 8 in. tie 24 (8 in. is the length C of the center section 42 of the crosstie element 28) has a bend angle A of approximately 135 degrees between the center section 42 of the crosstie element 28 and the first portion 46 of the second side section 45 of the crosstie element 28. In another embodiment, as shown in FIG. 10, a 6 in. tie 24 (6 in. is the length D of the center section 42 of the crosstie element 28) has a bend angle B of approximately 120 degrees between the center section 42 of the crosstie element 28 and the first portion 46 of the second side section 45 of the crosstie element 28.

Figure 11:
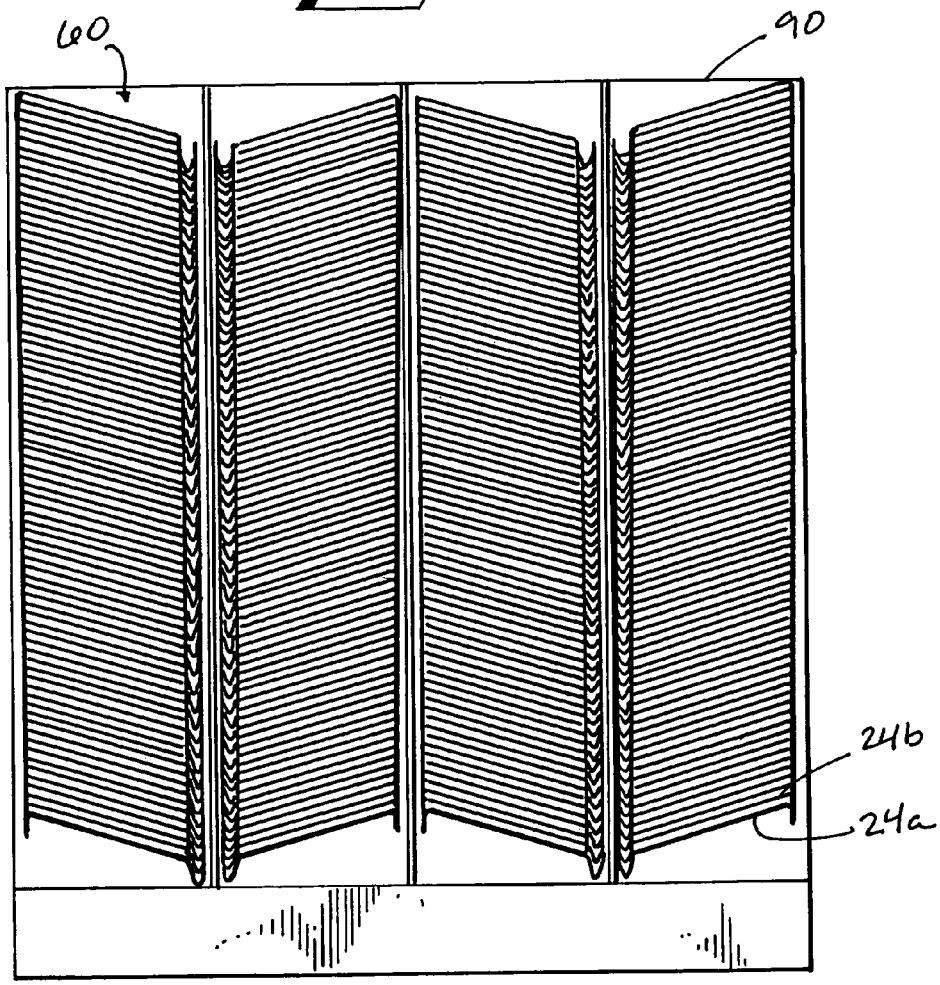
FIG. 11 is a top plan view of a pallet of nested Z-bend ties in accordance with the present invention.
Figure 11A:
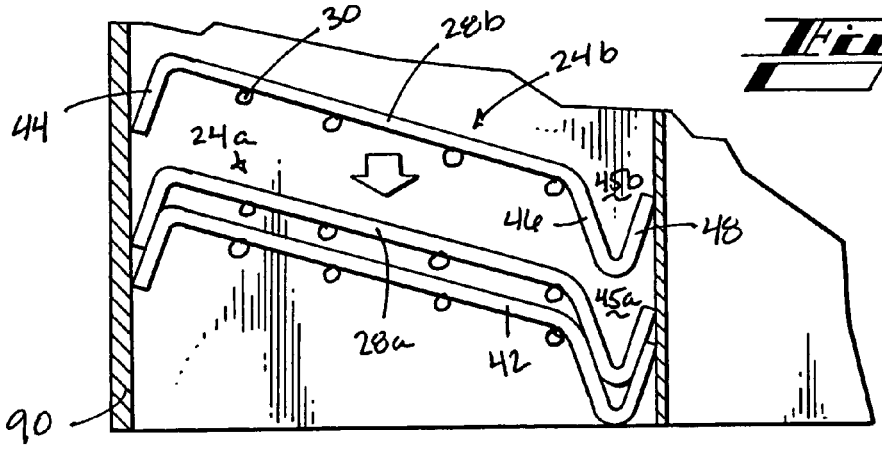
FIG. 11A is a top plan view of Z-bend ties nesting in a pallet in accordance with the present invention

With reference to FIG. 11*a*, ties 24 in accordance with the present invention are shown nesting in a pallet 90. Specifically, FIG. 1 la shows that a second side section 45*a* of a crosstie element 28*a* of a first tie 24*a* is adapted to receive a like second side section 45*b* of a like crosstie element 28*b* of a second tie 24*b* for nesting the first tie 24*a* and the second tie 24*b*. FIG. 11 shows the arrangement of four different nested stacks 60 on a pallet 90.

Pallets 90 of ties 24 may be organized for transport in 40 ft. containers. A typical 40 ft. container has a useable interior volume of about 2,500 cubic feet and a net weight capacity of 40,000 lbs of product. This size and capacity equate to a density of 16 lbs per cubic foot of packaged product, if every square inch of space in the container is used. Allowing for pallets 90, other dunnage, and some maneuverability space to load and unload the container, an actual product density of about 20 lbs per cubic foot is desired to achieve a practical utilization of the container's weight capacity and cubic volume capacity simultaneously.

Therefore, in order to achieve the target density of about 20 lbs per cubic foot of product, the ties 24 must nest within the stack 60 to a pitch, or spacing, of 27 layers of ties per foot of depth (27 layers per foot×0.75 lbs per square foot per layer=20 lbs per cubic foot density). This stack configuration equates to an average spacing of ties 24 (from bottom most surface of one tie to the bottom most surface of the next) of about 0.44 in.

In one embodiment, the tie 24 is constructed of two layers of 3.0 mm wire and one layer of 0.7 mm sheet metal, giving a total construction thickness of about 0.27 in. To achieve the pitch of 0.44 in., the space between nested parts must be 0.17 in. or less. Similar calculations must be undertaken if molded plastic ties are substituted for the wire ties 14.

Therefore, in order to achieve the target density of 20 lbs per cubic foot of product, the conventional ties 14 must nest to a pitch, or spacing, of 27 layers of ties 14 per foot of depth (27 layers×0.75 lbs per square foot per layer=20 lbs per cubic foot density). This configuration equates to an average spacing of ties 14 (from bottom most surface of one tie 14 to the bottom most surface of the next tie 14) of 0.44 in.

The conventional tie 14 is constructed of two layers of 3.0 mm wire and one layer of 0.7 mm sheet metal, giving a total construction thickness of about 0.27 in. To achieve the pitch of 0.44 in., the space between nested parts must be 0.17 in. or less. Similar calculations must be undertaken if molded plastic ties are substituted for the wire ties 24.

While this invention has been described with reference to preferred embodiments thereof, it is to be understood that variations and modifications can be affected within the spirit and scope of the invention as described herein and as described in the appended claims.

We claim:

1. A tie for an insulated concrete form comprising:

a. a series of crosstie elements intersecting with and connected to a series of reinforcing elements, wherein the crosstie elements each have a first side section, a central section, and a second side section, the second side section including a first portion connected to the central section and a second portion connected to the first portion;

b. a first planar section defined by the intersections of the central sections of the crosstie elements and reinforcing elements, the first planar section having a first side and a second side;

c. a second planar section defined by and including the first side sections of the crosstie elements, wherein the second planar section is connected along a line to the first side of the first planar section at an angle of approximately 90 degrees and wherein the second planar section coincides with a first furring strip that is attached to the first side sections;

d. a third planar section defined by and including the first portions of the crosstie elements, wherein the third planar section is connected along a line to the second side of the first planar section at an angle greater than 90 degrees; and e. a fourth planar section defined by and including the second portions of the crosstie elements, wherein the fourth planar section is connected along a line to the third planar section at an angle less than 90 degrees and wherein the fourth planar section coincides with a second furring strip that is attached to the second portion of the second side section.

2. The tie of claim 1, wherein the third planar section is connected to the second side of the first planar section at an angle of about 120 degrees.

3. The tie of claim 1, wherein the third planar section is connected to the second side of the first planar section at an angle of about 135 degrees.

4. The tie of claim 1, wherein the at least one crosstie element is configured to receive a like crosstie element of a second tie for nesting the first tie and the second tie with the first planar section of the first tie and the first planar section of the second tie parallel to each other.

* * * * *